United States Patent [19]

Yamashita

[11] Patent Number: 4,597,661

[45] Date of Patent: Jul. 1, 1986

[54] MAGNET ROLL ASSEMBLY

[75] Inventor: Keitaro Yamashita, Kansato, Japan

[73] Assignee: Hitachi Metals Ltd., Tokyo, Japan

[21] Appl. No.: 601,166

[22] Filed: Apr. 17, 1984

[30] Foreign Application Priority Data

Apr. 18, 1983 [JP] Japan ..... 58-67036

[51] Int. Cl.[4] ..... G03G 15/09

[52] U.S. Cl. ..... 355/3 DD; 118/658; 118/661

[58] Field of Search ..... 355/3 R, 3 DD, 14 D; 118/656, 657, 658, 661

[56] References Cited

U.S. PATENT DOCUMENTS

| | | | |
|---|---|---|---|
| 3,982,498 | 9/1976 | Wilcox | 355/3 DD X |
| 4,030,447 | 6/1977 | Takahashi et al. | 355/3 DD X |
| 4,034,709 | 7/1977 | Fraser et al. | 355/3 DD X |
| 4,171,900 | 10/1979 | Brugger et al. | 355/3 DD |
| 4,377,332 | 3/1983 | Tamura | 355/3 DD |

*Primary Examiner*—Fred L. Braun

*Attorney, Agent, or Firm*—Finnegan, Henderson, Farabow, Garrett & Dunner

[57] ABSTRACT

A magnet roll assembly for use in an apparatus developing an electrostatic latent image has a permanent magnet member providing a plurality of circumferentially spaced magnetic poles and a non-magnetic sleeve surrounding the permanent magnet member, the non-magnetic sleeve having a roughened surface region terminating at both ends inward relative to both ends of the permanent magnet member, a distance which can be proportional to the pitch of the magnetic poles at the sleeve surface whereby a magnetic developer layer of substantially uniform height is formed along the length of the sleeve surface. The surface roughness of the roughned surface region of the sleeve lies preferably within the range of from 0.5 μm to 3 μm (Rz). The magnet roll assembly is applicable to both magnetic brush-type and jumping-type developing apparatuses.

9 Claims, 7 Drawing Figures

MAGNET ROLL ASSEMBLY

BACKGROUND OF THE INVENTION (1) Field of the Invention

This invention relates to a developing apparatus used in electrophotographic copying devices or electrostatic recording devices. More particularly, this invention relates to a magnet roll assembly for use in jumping-type or magnetic brush-type developing devices.

(2) Description of the Prior Art

In an electrophotographic copying apparatus or an electrostatic recording apparatus, a developing apparatus of the jumping-type or the magnetic brush-type is provided for developing an electrostatic latent image. The image is formed on a photosensitive surface comprised of materials such as selenium or zinc oxide or on dielectric surface. The developing apparatus of the jumping-type or the magnetic brush-type comprises a magnet roll assembly including a permanent magnet and a non-magnetic cylindrical sleeve surrounding the magnet roll. In each of these apparatuses, a magnetic developer is attracted onto the sleeve to form a magnetic brush of the magnetic developer. In the case of the magnetic brush-type developing apparatus, the magnetic brush moves together with the sleeve due to the rotation of the sleeve relative to the magnet roll and rubs the surface of a member carrying an electrostatic latent image to develop the latent image. In the case of the jumping-type developing apparatus, the magnetic brush does not come into direct contact with the surface of a member carrying an electrostatic latent image because the height of the magnetic brush is relatively small. Instead, an AC bias voltage is applied across the sleeve and the latent image-carrying member to cause jumping of the developer onto the surface of the latent image-carrying member to develop the latent image.

The magnetic developer may be of two types. A two-component developer is a mixture of a ferromagnetic carrier and a toner. A single-component developer consists only of a magnetic toner. In the two-component developer, powder of coated or non-coated iron, nickel or ferrite having a particle size of about 50 μm to 200 μm is commonly used as the ferromagnetic carrier, and a dispersion of coloring agent powder in resin powder having a particle size of about 5 μm to 30 μm is used as the toner. On the other hand, the magnetic toner in the single-component developer consists essentially of resin particles containing magnetic powder having a particle size of 5 μm to 50 μm.

In regard to the developing devices of the above types roughening of the surface of the sleeve has been proposed for the purpose of improving the toner conveyability. For example, Japanese Patent Application Laid-open No. 56-134445 (1981) discloses that the surface of the sleeve is roughened by shotblasting or sandblasting so as to enhance the toner conveyability and also to improve the image developability. Also, Japanese Patent Application Laid-open No. 56-113172 (1981) (corresponding to U.S. Pat. No. 4,377,332) disclosed that the surface of the sleeve is ground with sandpaper, abrasives or the like in the axial or circumferential direction for roughening the surface of the sleeve.

It has thus been well known that roughening of the surface of the sleeve increases the friction between the sleeve and the toner, to improve the toner conveyability. In the prior art developing apparatus, however, the length of the roughened area of the sleeve is equal to or larger than that of the magnetic poles of the magnet roll, so both end portions of the magnetic brush formed on the sleeve tend to be higher than those in between due to the leakage of the magnetic flux at the ends of the magnet, resulting in undesirable non-uniformity of the magnetic brush in the axial direction. It has therefore been the common practice that the width of a latent image to be developed is made shorter than the length of the magnet roll to obviate the problems of the axial non-uniformity of the magnetic brush.

OBJECTS AND SUMMARY OF THE INVENTION

It is an object of the present invention to provide a magnet roll assembly for use in an electrostatic latent image-developing apparatus, which can form a magnetic brush which is substantially uniform throughout the axial length of the sleeve.

Another object of the present invention is eliminate the effects of flux leakage at the ends of a magnet roll.

The magnet roll assembly according to the present invention comprises a cylindrical sleeve of a non-magnetic material disposed opposite to a member adapted to carry an electrostatic latent image on its surface and a permanent magnet member housed within the sleeve and including a plurality of magnetic poles, the non-magnetic sleeve being rotatable relative to the permanent magnet member and having a roughened surface region whose length is shorter than that of the magnetic poles.

The number of the magnetic poles of the permanent magnet member may be selected depending on the size and intended use of the magnet roll assembly. Further, the permanent magnet member can be formed, for example, by sintering a powder of a magnetic material, such as ferrite, or by molding a mixture of magnetic powder and plastic powder into the shape.

The non-magnetic sleeve may be constructed such that the permanent magnet member can be housed therein to result in relative rotation between the sleeve and the member. The term "relative rotation" used herein includes both cases that one of these members rotates while the other is held stationary, and that both of them rotate at different speeds. Since means for insuring the relative rotation of these members is well known to those skilled in the art, such means will not be described in detail herein.

The sleeve surrounding the permanent magnet member is usually formed of a non-magnetic materials such as aluminum and stainless steel. The present invention is applicable to such a sleeve of whatever shape and size.

It is known that, in conveying a magnetic toner by a magnet roll assembly, the sleeve's capability of conveying the toner can be improved by roughening the sleeve surface, making the magnetic brush higher. The magnetic brush overlying both ends of the magnet tends to be higher than between the ends due to the leakage of the magnetic flux at both ends of the magnet.

The present invention is based on the discovery that, by the combination of the above-described reverse tendencies of the magnetic brush, the magnetic brush formed on the sleeve can be made uniform in height in the axial direction of the sleeve, free from undesirable enhancement at both ends of the magnet. The magnetic force at both ends of the magnet increases in proportion to the circumferential distance between the north and south poles or the pitch of the magnetic poles. Therefore, the length of the non-roughened portion of the sleeve surface overlying each end of the magnet can be determined on the basis of the pitch of the magnetic poles.

More specifically, the length of the non-roughened portions of the sleeve surface can be determined by taking into consideration the various factors influencing the height of the magnetic brush, including the outer diameter, and magnetic force of the permanent magnet, the number of magnetic poles, the surface roughness of the sleeve, and the types of the magnetic developer.

The surface roughness of the sleeve preferably lies within the range of 0.5 μm to 3 μm (Rz) when a magnetic toner is used. Since the particle size of the magnetic toner is generally more than about 5 μm, the tendency of the magnetic toner to enter the fine concavities of the sleeve and to become attached to the sleeve surface could be prevented to some extent if the surface roughness of the sleeve is selected to be less than 5 μm. However, in view of the fact that the capability of holding the toner on the sleeve surface by friction is not necessarily stable when the surface roughness of the sleeve exceeds 3 μm, it is preferable to select the surface roughness to be less than 3 μm. On the other hand, when the surface roughness of the sleeve is excessively small, the toner conveyability of the sleeve is not substantially improved, and, also, the sleeve tends to be easily subject to abrasive wear by frictional engagement with the toner. It is therefore preferable to set the lower limit of the surface roughness at 0.5 μm.

The magnet roll assembly according to the present invention can be incorporated in any type of electrostatic latent-image developing apparatus.

BRIEF DESCRIPTION OF THE DRAWINGS

The preferred embodiments of the present invention will be described in detail with reference to the accompanying drawings, in which.

DESCRIPTION OF THE PREFERRED EMBODIMENTS

Figure 1:
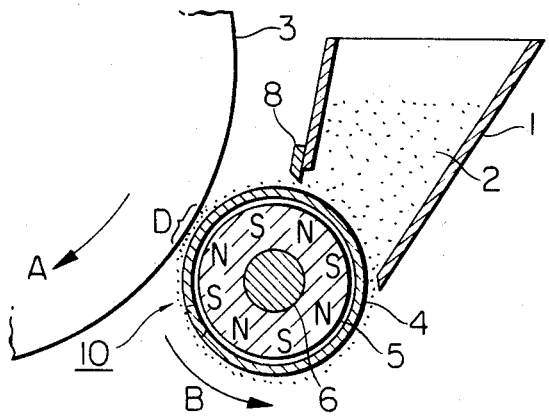
FIG. 1 is a sectional view of the magnet roll assembly according to one embodiment of the present invention.

Referring to FIG. 1, a hopper 1 containing a magnetic toner 2 is disposed above a magnet roll assembly 10 closely adjacent to the latter. A doctor member 8 is mounted on the lower end of the hopper 1. The magnet roll assembly 10 includes a permanent magnet member 5 mounted on a shaft 6 and a cylindrical sleeve 4 mounted on another shaft (not shown).

In the illustrated embodiment, the permanent magnet member 5 has four N poles and four S poles. A photosensitive drum 3 is disposed in close proximity to the surface of the cylindrical sleeve 4. In the developing apparatus comprising the magnet roll assembly 10 according to this embodiment of the present invention, the photosensitive drum 3 rotates in a direction as shown by the arrow A, and the cylindrical sleeve 4 rotates in a direction as shown by the arrow B, while the shaft 6 is held stationary.

The magnetic toner 2 contained in the hopper 1 is attracted onto the sleeve 4 by the magnetic force of the permanent magnet member 5, and is conveyed by the sleeve surface in the direction of the arrow B with its thickness restricted by the doctor 8. The magnetic toner 2 being conveyed on the sleeve 4 arrives at a developing region D where the sleeve 4 is opposed by the photosensitive drum 3. In this developing region D, a magnetic brush formed on the sleeve 4 comes into contact with the surface of the photosensitive drum 3, to develop an electrostatic latent image (not shown) carried on the drum 3. Any excess of the magnetic toner 2 remains on the sleeve 4 after having passed the developing region D, is returned to the hopper 1 by the rotation of the sleeve 4.

Figure 2:
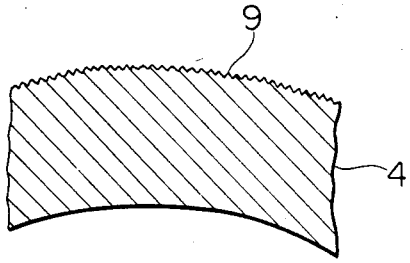
FIG. 2 is an enlarged sectional view of part of the cylindrical sleeve shown in FIG. 1.
Figure 3:
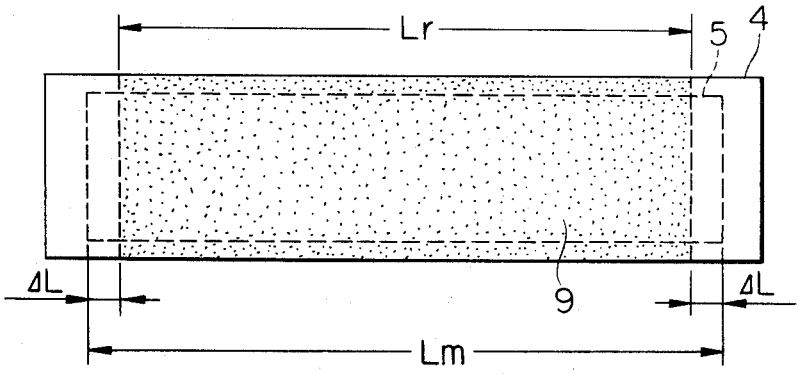
FIG. 3 is a front elevational view of the cylindrical sleeve surrounding the magnet roll.

Referring to FIGS. 2 and 3, a randomly roughened area 9 is formed on the surface of the sleeve 4 by surface treatment such as sandblasting and shotblasting. The roughening of the surface of the sleeve 4 eliminates the sliding of the toner in the form of magnetic brush on the sleeve surface during conveyance of the magnetic toner 2. The magnetic toner 2 can be reliably conveyed in the direction of rotation of the sleeve 4. The image developability can thus be improved by virtue of the improved toner conveyability.

As shown in FIG. 3, the roughened region 9 of length Lr formed on the sleeve surface terminates at both ends and is shorter by 2ΔL than the permanent magnet member 5 having a length Lm. The reason therefor will be described with reference to FIGS. 4 and 5.

Figure 4:
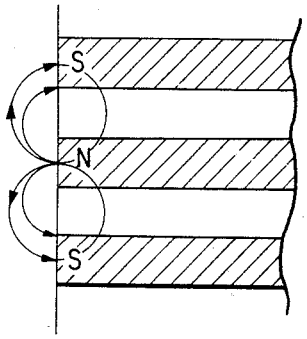
FIG. 4 a schematic view showing the magnetic flux at one end of the permanent magnet member.
Figure 5:
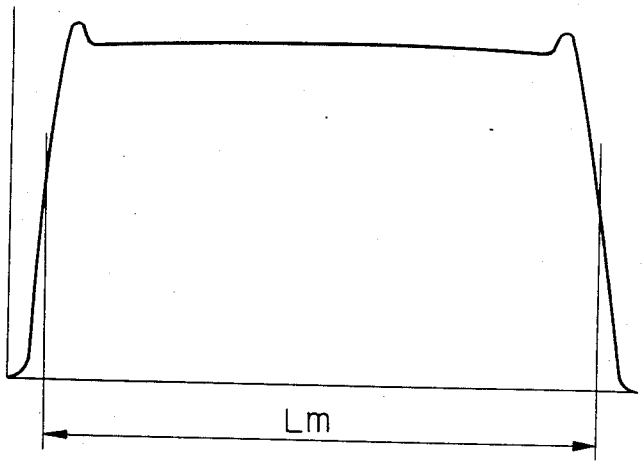
FIG. 5 is a graph showing the magnetic flux density distribution along the sleeve.
Figure 6:
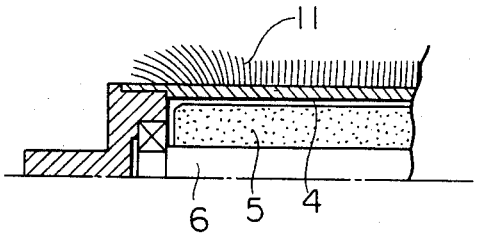
FIG. 6 is a schematic view showing part of the magnetic brush formed on the sleeve whose overall surface is roughened.

As shown in FIG. 4, the magnetic flux flows out in an arcuate fashion from the N pole toward the adjacent S poles at each end of the permanent magnet member 5. Thus, the lines of magnetic flux flowing outward from both ends of the permanent magnet member 5 are inclined, and the magnetic flux density is higher at both ends of the permanent magnet member 5 than in between as shown in FIG. 5. If the surface of the sleeve 4 surrounding the permanent magnet member 5 is uniform throughout its length, the magnetic brush 11 formed on the sleeve 4 would be higher at both ends than in between as shown in FIG. 6. However, because the toner conveyability at the portions ΔL (not roughened) of the sleeve 4 is smaller than that of the portion Lr (roughened) of the sleeve 4, the tendency of having a higher magnetic brush at both ends of the magnet due to the magnetic flux leakage is eliminated. This causes the height of the magnetic brush 11 substantially to be uniform along the length of the sleeve 4.

Figure 7:
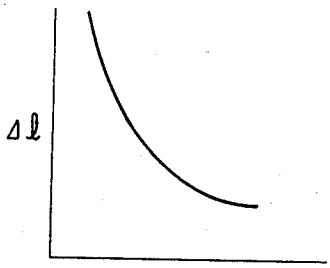
FIG. 7 is a graph showing the relation between ΔL in FIG. 3 and the number of magnetic poles of the permanent magnet member.

The length of the not-roughened portions ΔL may be selected to be proportional to the pitch of the magnetic poles. The relation between ΔL and the number of magnetic poles is shown in FIG. 7.

The present invention has been explained with the use of a single-component developer. When it is desired to develop an electrostatic latent image with a two-component developer, grooves such as those described in Japanese Patent Application Laid-open No. 53-3347 (1978) may be provided on the surface of the sleeve 4, for instance, by knurling in lieu of the aforementioned random roughening of the sleeve surface by sandblasting. When the sleeve surface is roughened by sandblasting, the resultant surface roughness is preferably within the range of from 5 μm to 30 μm (Rz). Further, when grooves are formed on the sleeve surface by knurling, sandblasting may also be applied to the knurled surface for further improving the toner conveyability.

EXAMPLE

A cylindrical member made of stainless steel and having an outer diameter of 32 mm was used as the sleeve 4, and a barium ferrite magnet having an outer diameter of 29 mm and including eight symmetric-magnetic poles providing a magnetic flux density of 550 G on the sleeve 4 was used as the permanent magnet member 5 to constitute the magnet roll assembly incorporated in the developing apparatus shown in FIG. 1. The gap between the doctor member 8 and the sleeve 4 was set at 0.3 mm, and the gap between the photosensitive drum 3 and the sleeve 4 was set at 0.3 mm.

While holding the permanent magnet member 5 stationary, the sleeve 4 was rotated at a speed of 200 rpm to develop an electrostatic latent image. A selenium drum having an outer diameter of 120 mm was used as the photosensitive drum 3 and was rotated at a peripheral speed of 100 mm/sec. The magnetic toner used for development was particles consisting of a mixture of 60 parts by weight of magnetic powder (EPT500 made by Toda Kogyo Co., Ltd.) and 40 parts by weight of a resin composition (a 7:3 mixture by weight of HIWAX200 made by Mitsui Petrochemical Co., Ltd. and ACP400 made by Allied Chemical Corporation), the particles being coated with 0.4 parts by weight of carbon black. The mean particle size of the magnetic toner thus prepared was about 15 μm, and its volume resistivity at DC 4,000 V/cm was $10^{14}$ Ω.cm.

Sandblasting with sands of various diameters was performed to prepare four sleeves 4 having surface roughnesses of 0.5 μm, 1.3 μm, 2 μm and 3 μm, respectively.

When the length Lm of the permanent magnet member 5 was 280 mm, and the length Lr of the roughened area of the sleeve 4 was also 280 mm, the magnetic brush was as high as 0.8 mm at both ends of each sleeve 4, as compared to 0.6 mm at the intermediate portion of the sleeve 4.

When non-roughened portions each having a length, ΔL, of 8 mm were provided at both ends of each of the sleeve 4, however, the height of the magnetic brush was substantially uniform in the axial direction of the sleeve 4. The same results were obtained for each of the sleeves having the surface roughness ranging from 0.5 μm to 3 μm.

It will be understood from the above that finely roughening a limited area of the sleeve surface which is somewhat shorter at both ends than the magnetic roll housed in the sleeve provides not only the improvement in the toner conveyability of the sleeve, but also the uniform distribution of the magnetic brush along the length of the sleeve. Therefore, uniform development of an electrostatic latent image along the length of the magnet roll assembly can be achieved.

While the salient features of the invention have been described with reference to the drawings, it should be understood that the described embodiments of the invention are susceptible of modification without departing from the spirit and scope of the following claims.

What is claimed is:

1. The magnet roll assembly for use in an apparatus for developing an electrostatic latent image with a magnetic brush, comprising:

a permanent magnet member having a first end and a second end;

a non-magnetic sleeve surrounding said permanent magnet member from said first end to said second end; and a roughened surface region on said sleeve terminating inwardly with respect to each end of said permanent magnet member, said non-magnetic sleeve adapted to carry a magnetic developer layer of substantially uniform height along the length thereof upon the application of toner to said roughened surface region and the portions of said sleeve outwardly thereof.

2. The magnet roll assembly according to claim 1, wherein the surface roughness of said region is within the range of from 0.5 μm to 3 μm (Rz).

3. The magnet roll assembly according to claim 2, wherein said region comprises a random pattern of indentations formed by sandblasting said region of said sleeve.

4. The magnet roll assembly according to claim 2, wherein said region comprises a plurality of circumferential grooves formed by knurling said region of said sleeve.

5. The magnet roll assembly according to claim 4, wherein said region further comprises a random pattern of indentations formed by sandblasting said region of said sleeve.

6. The magnet roll assembly according to claim 2, wherein said sleeve comprises stainless steel and said magnetic roll includes a barium ferrite magnet.

7. The magnet roll apparatus according to claim 2 wherein said permanent magnet member provides eight alternating, circumferentially spaced poles at the surface of said non-magnetic sleeve; said non-magnetic sleeve has a diameter of about 32 mm; and the axial distance between the end of said permanent magnet member and the inwardly terminating end of said roughened sleeve surface region is about 8 mm.

8. The magnet roll assembly according to claim 1 wherein said permanent magnet member provides a plurality of alternating magnetic poles to be circumferentially spaced about the periphery of the non-magnetic sleeve, and wherein the axial distance between the end of said permanent magnet member and the inwardly terminating ends of said roughened sleeve surface region is proportional to the pitch of said magnetic poles.

9. A magnet roll assembly for use in an apparatus for developing an electrostatic latent image with a magnetic brush, comprising:

a permanent magnet member having a first end and a second end and providing a plurality of circumferentially spaced magnetic poles along the axial length thereof;

a non-magnetic sleeve surrounding said permanent magnet member from said first end to said second end; and a roughened surface region on said sleeve terminating inwardly with respect to each end of said permanent magnet member, the surface roughness of said region being within the range of from 0.5 μm to 3 μm (Rz), the distance between the end of said permanent magnet member and the inwardly terminating end of said roughened sleeve surface region being proportional to the pitch of said magnetic poles at the sleeve surface, said non-magnetic sleeve adapted to carry a magnetic developer layer of substantially uniform height along the length thereof upon the application of toner to said roughened surface region and the portions of said sleeve outwardly thereof.

* * * * *